US005713779A

United States Patent [19]

Chen

[11] Patent Number: 5,713,779

[45] Date of Patent: Feb. 3, 1998

[54] TOY DOLL WITH A ROTARY DOLL HEAD

[76] Inventor: Chao-Yang Chen, 8f-3, No. 321, Fu Hsing S. Rd., Sec. 1, Taipei, Taiwan

[21] Appl. No.: 670,530

[22] Filed: Jun. 27, 1996

[51] Int. Cl.[6] ..... A63H 3/02

[52] U.S. Cl. ..... 446/353; 446/384; 446/391; 446/369

[58] Field of Search ..... 446/223, 268, 446/338, 340, 352, 353, 376, 384, 390, 391, 369

[56] References Cited

U.S. PATENT DOCUMENTS

| | | | |
|---|---|---|---|
| D. 123,389 | 11/1940 | Dunlap . | |
| 1,274,328 | 7/1918 | Price | 446/369 |
| 2,572,285 | 10/1951 | Schumacher et al. | 446/390 |
| 2,826,000 | 3/1958 | Fischman et al. | 446/223 |
| 3,099,895 | 8/1963 | Beebe | 446/376 |
| 3,295,253 | 1/1967 | Gardel et al. | 446/338 |
| 3,613,299 | 10/1971 | Amici et al. | 446/353 |
| 3,699,715 | 10/1972 | Lewis et al. | 446/376 |
| 4,662,857 | 5/1987 | Quinn et al. | 446/384 |
| 4,824,410 | 4/1989 | Sommer | 446/376 |
| 5,304,087 | 4/1994 | Terzian et al. | 446/384 |
| 5,503,311 | 4/1996 | Chen | 446/73 |

*Primary Examiner*—Robert A. Hafer
*Assistant Examiner*—Jeffrey D. Carlson
*Attorney, Agent, or Firm*—Bacon & Thomas

[57] ABSTRACT

A toy doll including a doll head having a skin and a hole through the skin; a doll body having a skin and a hole through the skin; a first hollow retaining knob inserted into the hole of the doll head, having a head attached to the skin of the doll head on the outside; a first retaining ring mounted around the first retaining knob within the hole of the doll head and closely attached to the skin of the doll head on the inside to firmly secure the first retaining knob to the skin of the doll head; a second retaining knob mounted in the hole of the doll body and fastened to the first retaining knob, having a head disposed inside the hole of the doll body and attached to the skin of the doll body on the inside, and a retaining stub tube fastened to the longitudinal center through hole of the first retaining knob to secure the doll body to the doll head for permitting the doll head to be rotated relative to the doll body; and a second retaining ring mounted around the second retaining knob and closely attached to the skin of said doll body on the outside to firmly secure the second retaining knob to the skin of the doll body.

6 Claims, 5 Drawing Sheets

TOY DOLL WITH A ROTARY DOLL HEAD

BACKGROUND OF THE INVENTION

The present invention relates to toy dolls, and relates more specifically to such a toy doll which permits the doll head to be rotated relative to the doll body.

Regular toy dolls generally have a skin (which has a profile shaped like an animal or cartoon figure) stuffed with cotton, sponge, cloth, or any suitable stuffing. If to make the doll head rotatable relative to the doll body, a swivel connecting means shall be used and installed in a bottom hole in the doll head and a top hole in the doll body. However, when a swivel connecting means is used and installed, the border area of the skin of the doll head as well as the border area of the skin of the doll body tend to be stretched and damaged upon the relative rotary motion between the doll head and the doll body. If a toy doll is made allowing the doll head to be rotated relative to the doll body without being limited to a fixed angle, the internal electric circuit means (for example, the electric wires connected between the battery box in the doll body and the lamps in the eyes of the doll head) tends to be tangled and broken. Furthermore, if to turn the doll head relative to the doll body by a motor, the motor must be installed on the inside of the toy doll and coupled to the doll head. However, the installation of such a motor is not easy.

SUMMARY OF THE INVENTION

It is one object of the present invention to provide a toy doll which permits the doll head and the doll body to be easily connected together and rotated relative to each other. It is another object of the present invention to provide a toy doll which limits the rotation of the doll head relative to the doll body within a fixed angle. It is still another object of the present invention to provide a toy doll which permits the doll head to be rotated relative to the doll body by a motor.

According to one embodiment of the present invention, the toy doll comprises a doll head having a skin and a hole through the skin; a doll body having a skin and a hole through the skin; a first hollow retaining knob inserted into the hole of the doll head, having a head attached to the skin of the doll head on the outside; a first retaining ring mounted around the first retaining knob within the hole of the doll head and closely attached to the skin of the doll head on the inside to firmly secure the first retaining knob to the skin of the doll head; a second retaining knob mounted in the hole of the doll body and fastened to the first retaining knob, having a head disposed inside the hole of the doll body and attached to the skin of the doll body on the inside, and a retaining stub tube fastened to the longitudinal center through hole of the first retaining knob to secure the doll body to the doll head for permitting the doll head to be rotated relative to the doll body; and a second retaining ring mounted around the second retaining knob and closely attached to the skin of said doll body on the outside to firmly secure the second retaining knob to the skin of the doll body.

DETAILED DESCRIPTION OF THE PREFERRED EMBODIMENT

Figure 1:
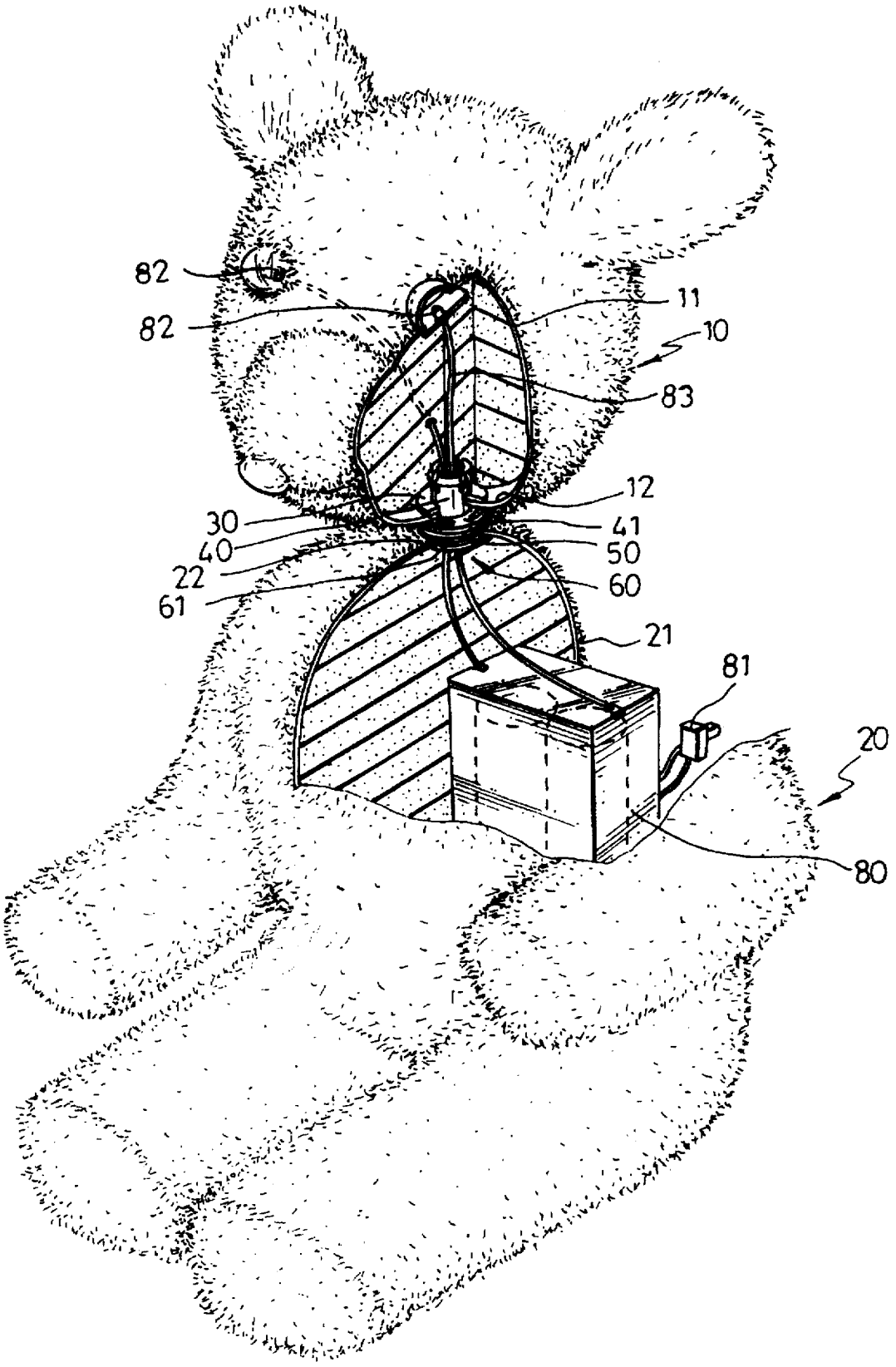
FIG. 1 is a cutaway view of a toy doll according to one embodiment of the present invention.

Referring to Figures from 1 to 3, a toy doll in accordance with one embodiment of the present invention is generally comprised of a doll head 10, and a doll body 20. The doll head 10 has a hole 12 through the skin 11 thereof. The skin 11 at the border of the hole 12 is retained in between a retaining ring, namely, the first retaining ring 30, and the head 41 of a hollow retaining button, namely, the first retaining button 40. The first retaining button 40 has an outside annular flange 43 adapted for securing the first retaining ring 30 in place. The doll body 20 has a hole 22 through the skin 21 thereof. The skin 21 at the border of the hole 22 is retained in between a retaining ring, namely, the second retaining ring 50, and the head 61 of a hollow retaining button, namely, the second retaining button 60. The second retaining button 60 has an outside annular flange 63 adapted for securing the second retaining ring 50 in place.

Figure 2:
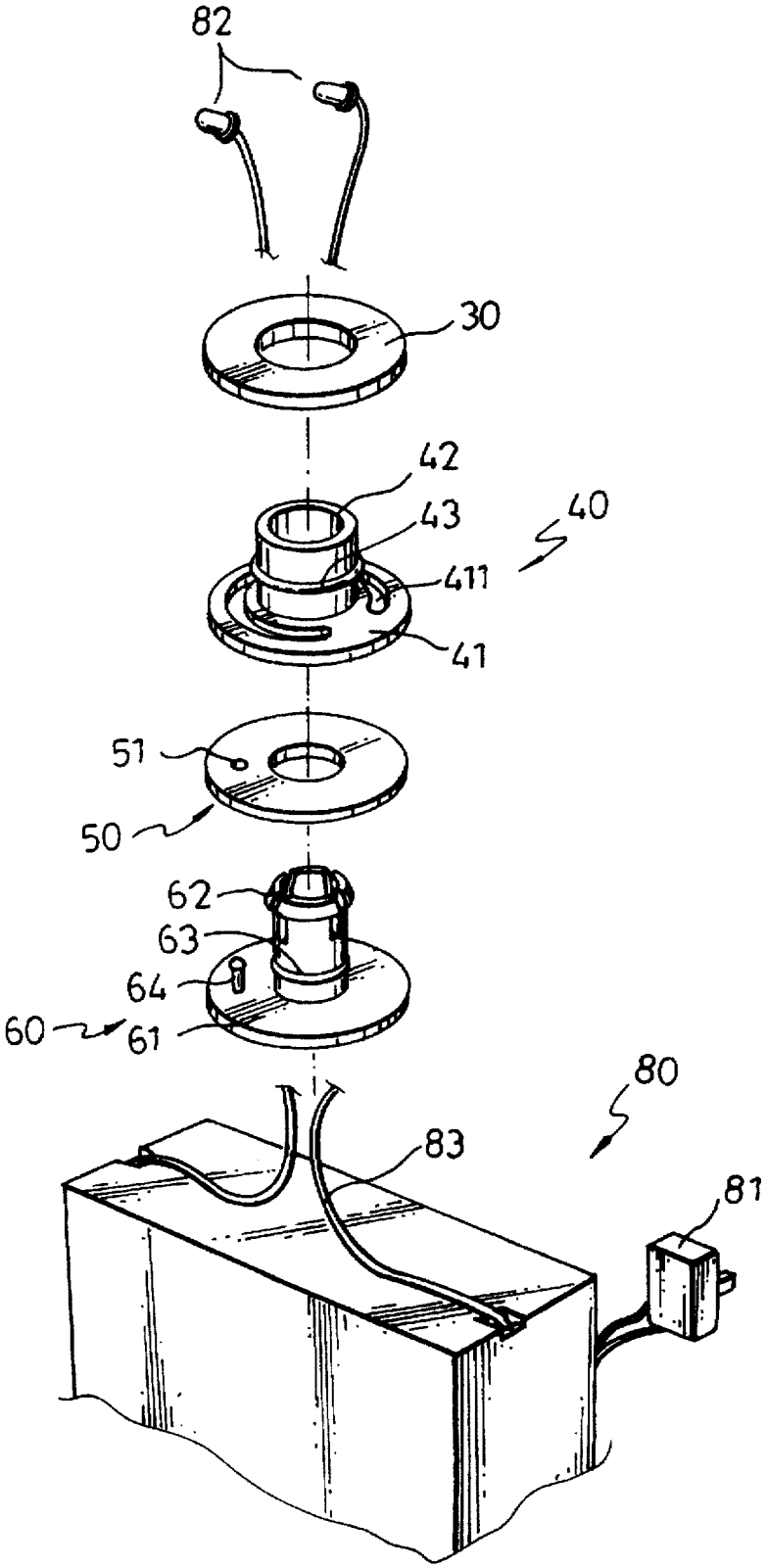
FIG. 2 is an exploded view of a part of FIG. 1, showing the relationship among the battery box, the switch, the lamps, the first retaining ring, the first retaining knob, the second retaining ring, and the second retaining knob.
Figure 3:
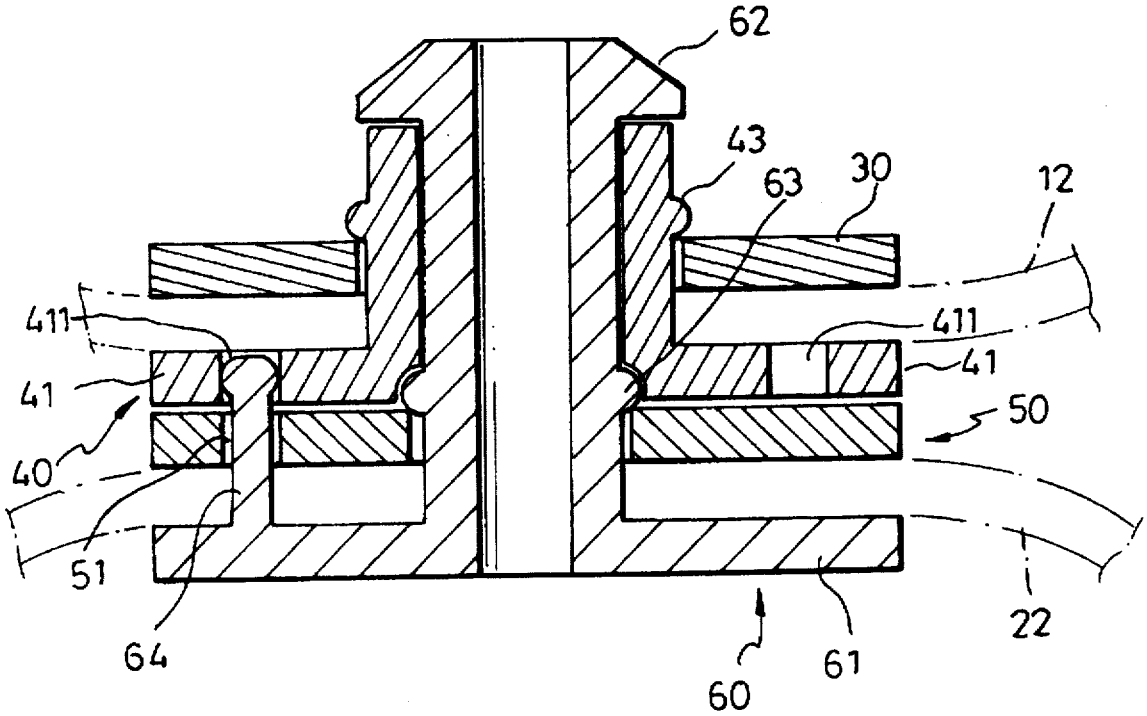
FIG. 3 is a sectional view of a part of FIG. 1, showing the first retaining knob fastened to the second retaining knob, the skin of the doll head retained between the first retaining ring and the first retaining knob, and the skin of the doll body retained between the second retaining ring and the second retaining knob.

Referring to FIGS. 2 and 3, the first retaining knob 40 has a longitudinal center through hole 42. The second retaining knob 60 has a hooked, split retaining stub tube 62 at the center of the head 61 and fastened to the longitudinal center through hole 42 of the first retaining knob 40. The head 41 of the first retaining knob 40 has a smoothly arched slot 411 around the longitudinal center through hole 42. The head 61 of the second retaining knob 60 has an upright pin 64 inserted through a through hole 51 in the retaining ring 50 into the smoothly arched slot 411 of the head 41 of the retaining knob 40. Therefore, the first retaining knob 40 (the doll head 10) can be rotated relative to the second retaining knob 60 (the doll body 20) within the limit of the smoothly arched slot 411.

Referring to FIGS. 1 and 2 again, a battery box 80 and a switch 81 are mounted inside the doll body 20. Two lamps 82 are mounted in the doll head 10 at the locations of the eyes, and connected to the battery box 80 by electric wires 83, which are inserted through the retaining stub tube 62 of the second retaining knob 60. When the doll head 10 is twisted relative to the doll body 20, the smoothly arched slot 411 of the head 41 of the first retaining knob 40 is moved relative to the upright pin 64 of the second retaining knob 60. Therefore, the angle of rotation of the doll head 10 is limited. This arraignment prevents the electric wires 83 from being excessively twisted.

Figure 4:
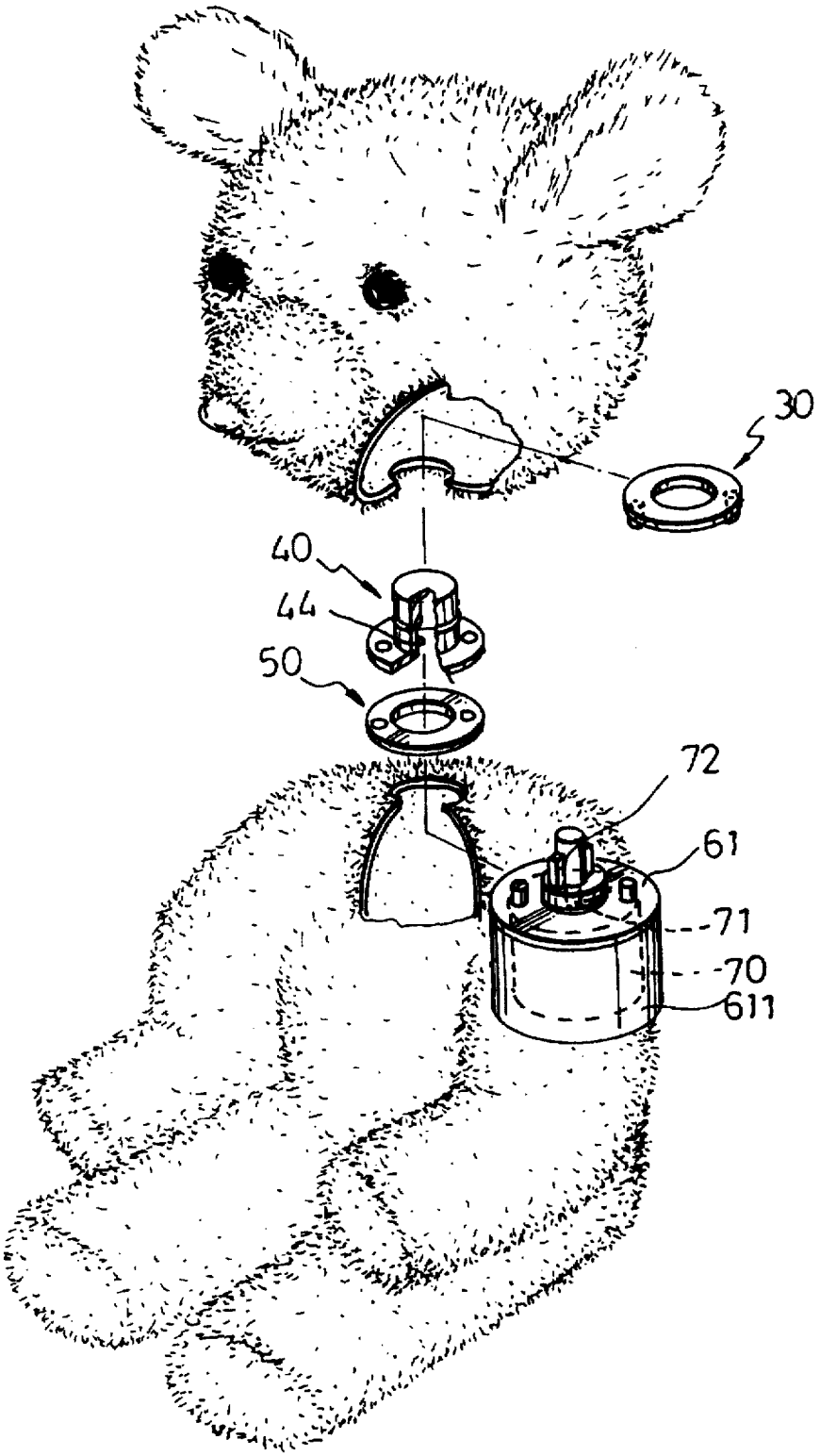
FIG. 4 is an exploded view of an alternate form of the present invention.
Figure 5:
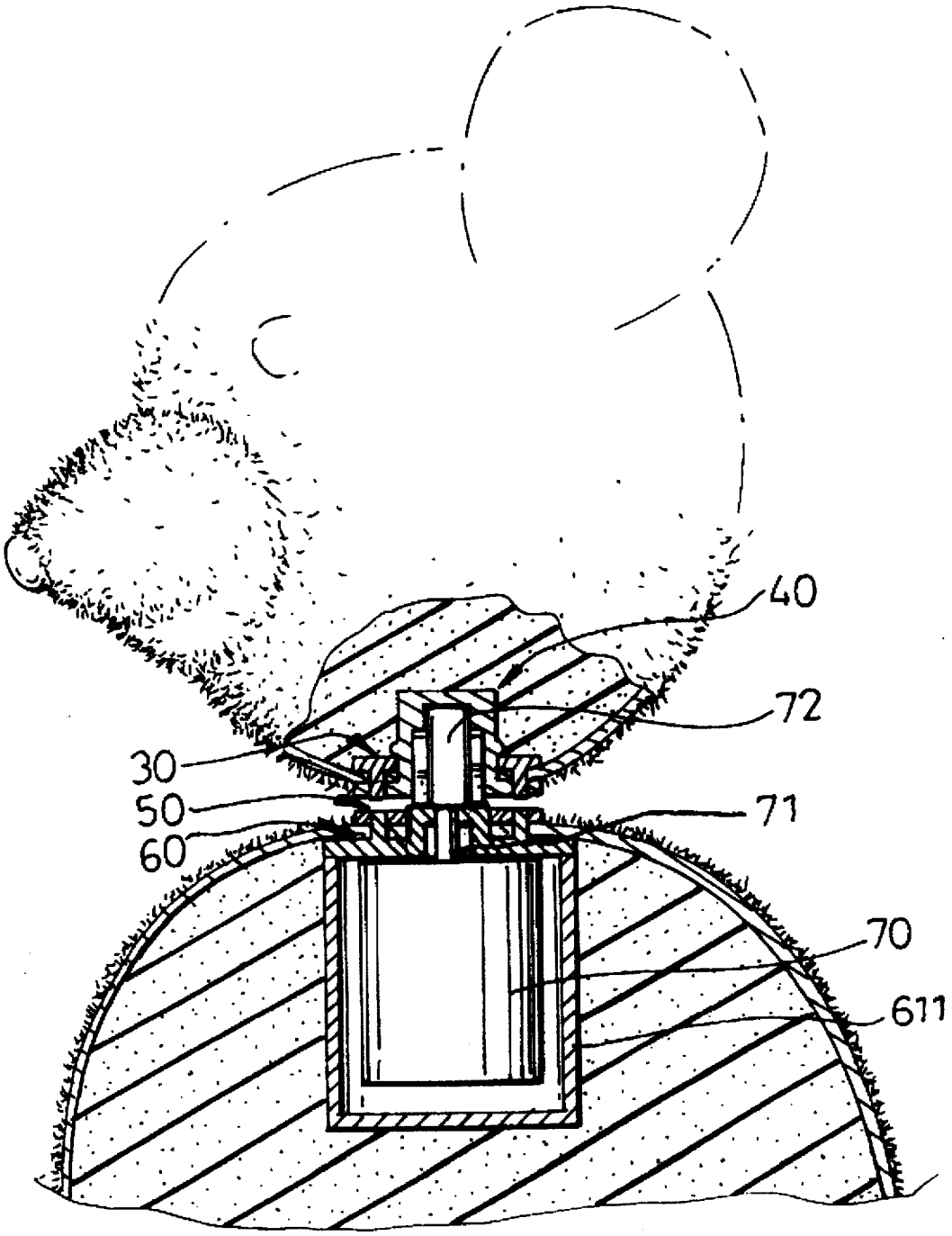
FIG. 5 is an assembly view in section of the toy doll shown in FIG. 4.

FIGS. 4 and 5 show an alternate form of the present invention. According to this alternate form, the first retaining knob 40 has a coupling portion 44 on the inside; the head 61 of the second retaining knob 60 is fixedly secured to a motor house 611, which holds a motor 70 on the inside. The motor 70 has a motor shaft 71, and a coupling 72 fixedly mounted around the motor shaft 71 and coupled to the coupling portion 44 of the first retaining knob 40.

It is to be understood that the drawings are designed for purposes of illustration only, and are not intended as a definition of the limits and scope of the invention disclosed. For example, the first retaining knob maybe made with a plurality of recessed portions at the bottom, and the second retaining knob may be made with a plurality of raised portions at the top adapted for engaging the recessed portions of the first retaining knob.

What the invention claimed is:

1. A toy doll comprising:

a doll head having a skin and a hole through the skin;

a doll body having a skin and a hole through the skin;

a first retaining knob inserted into the hole of said doll head, said first retaining knob comprising a first head in contact with the skin of said doll head on the outside, said first knob also having a first hollow stub tube extending from the first retaining knob head into the doll head, the first hollow stub tube having a longitudinal center through hole and a first retaining flange extending therefrom;

a first retaining ring mounted around said first hollow stub tube within the hole of said doll head and held in contact with the skin of said doll head on the inside by the first retaining flange to firmly secure said first retaining knob to the skin of said doll head;

a second retaining knob mounted in the hole of said doll body, said second retaining knob comprising a second head disposed inside the hole of said doll body in contact with the skin of said doll body on the inside, a second hollow retaining stub tube having second and third retaining flanges extending therefrom, said second hollow retaining stub tube extending through the first hollow stub tube so as to rotatably attach the first hollow stub tube thereto between the second and third retaining flanges to secure said doll body to said doll head for permitting said doll head to be rotated relative to said doll body; and a second retaining ring mounted around said second hollow stub tube and held in contact with the skin of said doll body on the outside by said second retaining flange to firmly secure said second retaining knob to the skin of said doll body.

2. The toy doll of claim 1 further comprising:

a smoothly arched slot in the head of said first retaining knob around said first hollow stub tube;

an upright pin extending from the head of said second retaining knob and inserted into the smoothly arched slot of the head of said first retaining knob to limit the angle of rotation of said doll head relative to said doll body; and a pin hole in said second retaining ring through which the upright pin of said second retaining knob passes.

3. A toy doll comprising:

a doll head having a skin and a hole through the skin;

a doll body having a skin and a hole through the skin;

a first retaining knob inserted into the hole of said doll head, said first retaining knob comprising a head attached to the skin of said doll head on the outside, and said first knob also having a coupling portion on an inside;

a first retaining ring mounted around said first retaining knob within the hole of said doll head and closely attached to the skin of said doll head on the inside to firmly secure said first retaining knob to the skin of said doll head;

a second retaining knob mounted in the hole of said doll body and fastened to said first retaining knob, said second retaining knob comprising a head disposed inside the hole of said doll body and attached to the skin of said doll body on the inside, said second knob also having a retaining stub tube disposed at the center of the head of said second retaining knob;

a second retaining ring mounted around said second retaining knob and closely attached to the skin of said doll body on the outside to firmly secure said second retaining knob to the skin of said doll body; and a motor housing base fixedly secured to the head of said second retaining knob, said motor housing base comprising a motor having a motor shaft extending through said second retaining knob, and a coupling fixedly mounted around said motor shaft and coupled to the coupling portion of said first retaining knob for permitting said first retaining knob with said doll head to be turned by said motor relative to said doll body.

4. The toy doll of claim 3 wherein said first retaining knob has an outside annular flange raised around the periphery and disposed inside the hole of said doll head; said first retaining ring is mounted around said first retaining knob and retained between the outside annular flange and head of said first retaining knob to hold down the skin of said doll head.

5. The toy doll of claim 3 wherein said second retaining knob has an outside annular flange raised around the periphery; said second retaining ring is mounted around said retaining stub tube of said second retaining knob and retaining between the outside annular flange and head of said second retaining knob to hold down the skin of said doll body.

6. The toy doll of claim 3 wherein said first retaining knob has a plurality of recessed portions at a bottom side thereof, said second retaining knob has a plurality of raised portions at a top side thereof respectively forced into engagement with the recessed portions of said first retaining knob.

* * * * *